United States Patent [19]

Barnes, Sr.

[11] Patent Number: 4,781,376

[45] Date of Patent: Nov. 1, 1988

[54] LIFE-LIKE BASEBALL PITCHER'S TRAINING DEVICE

[76] Inventor: Dave Barnes, Sr., 341 Frey La., Fairview Heights, Ill. 62208

[21] Appl. No.: 47,688

[22] Filed: May 7, 1987

[51] Int. Cl.[4] ..... A63B 69/40

[52] U.S. Cl. ..... 273/26 A

[58] Field of Search ..... 273/26 R, 26 A

[56] References Cited

U.S. PATENT DOCUMENTS

| | | | |
|---|---|---|---|
| 884,462 | 4/1908 | Bryant | 273/26 A |
| 1,170,715 | 2/1916 | Westgate | 273/26 A |
| 1,507,343 | 9/1924 | Degenhardt | 273/26 A |
| 2,040,228 | 5/1936 | Whiteley | 273/26 A |
| 2,254,986 | 9/1941 | Ziel | 273/26 A |
| 2,628,097 | 2/1953 | Leczar | 273/26 A |
| 3,871,647 | 3/1975 | Tellez | 273/26 A |

*Primary Examiner*—Richard C. Pinkham
*Assistant Examiner*—T. Brown
*Attorney, Agent, or Firm*—Glenn K. Robbins

[57] ABSTRACT

A training device for pitchers. The training device provides a target comprising a catcher figure and separate batter figure. Both the catcher figure and batter figure are adjustable in height to simulate different sized batters from Little League to adult size. The batter figure can be supported as a left or right handed batter and is pivotable as well as adjustable in distance from the catcher to simulate different batter box positions. A catcher's mitt target is supported on the catcher figure in different positions for different pitches and has an alarm in the pocket of the mitt to indicate an on-target pitch.

12 Claims, 3 Drawing Sheets

LIFE-LIKE BASEBALL PITCHER'S TRAINING DEVICE

BACKGROUND OF THE INVENTION

There has long been a need for baseball pitching targets in order that pitchers, young and old, can develop their pitching skills. With the advent of organized leagues for children various types of targets ranging from a bullseye target on a backboard to simulations of the figures of a batter and a pitcher have been utilized.

It has been a particular problem to develop a target pitcher's training aid that approaches a real-life and actual condition pitching situation. Fixed targets do not present a changing situation where a pitch may be desired high, low, inside or outside to batters that may be right or left handed and of different sizes and at different positions in a batters box. While some targets or training devices have utilized interchangeable left or right handed batters and even batters of different sizes there has remained a need for presenting a relatively simple pitcher's training device or target where the stance and position in the batter's box with size variation of both catcher and batter and desired location of pitch can all be provided.

SUMMARY OF THE INVENTION

By means of the instant invention there has been provided a pitcher's training device fullfilling the different variables in size of batter and pitcher, location of batter in batter's box and location of pitch called for.

The training device is comprised of a figure of a catcher which may be simply supported on the ground in a park, playground, backyard or the like. For size adjustment the figure is comprised of upper and lower sections which may be lowered or raised to simulate different sized catchers.

To develop accuracy, a catcher's mitt is adapted to be supported on the figure of the catcher in different adjustment positions for high, low, inside or outside pitches. A visual or audible alarm is positioned in the center or pocket of the catcher's mitt to signal a perfect targeted pitch.

In order to give the pitcher a sense of realism and game conditions the pitching device is further provided with a figure of a batter. The batter figure may be positioned as either a right or left handed batter and like the catcher figure has means for size adjustment. This is effected by providing upper and lower halves with the upper half being adapted to be raised or lowered for the effect of taller or shorter batters.

Variation of positions of the batter is effected by pivotally supporting the batter figure to the catcher figure such as by a hinge connecting the batter to the catcher through a support rod. The support rod is telescopic in order that the distance can be varied from a "crowding the plate" position to a further distance between the two. For ease in support of the batter a ground engaging stake fixed to the batter may be used as a ground rest.

The construction of the catcher figure and batter figure is conveniently made of a rigid sheet material such as plywood or the like covered at the front by a rubber or plastic sheet for resilience and to prevent damage to the baseballs utilized.

A ball retaining net may be positioned to enclose the sides, top and rear of the batter and pitcher figures. A light weight portable frame for the net resting on the ground ensures easy ball recovery.

The light weight baseball pitching target is simply constructed and installed. It may be easily employed by children and adults, as well, to develop pitching skills under the different variables employed in as much like a game environment as practical.

The above features are objects of this invention. Further objects will appear in the detailed description which follows and will be further apparent to those skilled in the art.

For the purpose of illustration of this invention, a preferred embodiment thereof is shown in the accompanying drawing. It is to be understood that the drawing is for purpose of description only and that the invention is not limited thereto.

IN THE DRAWING

DESCRIPTION OF THE INVENTION

Figure 1:
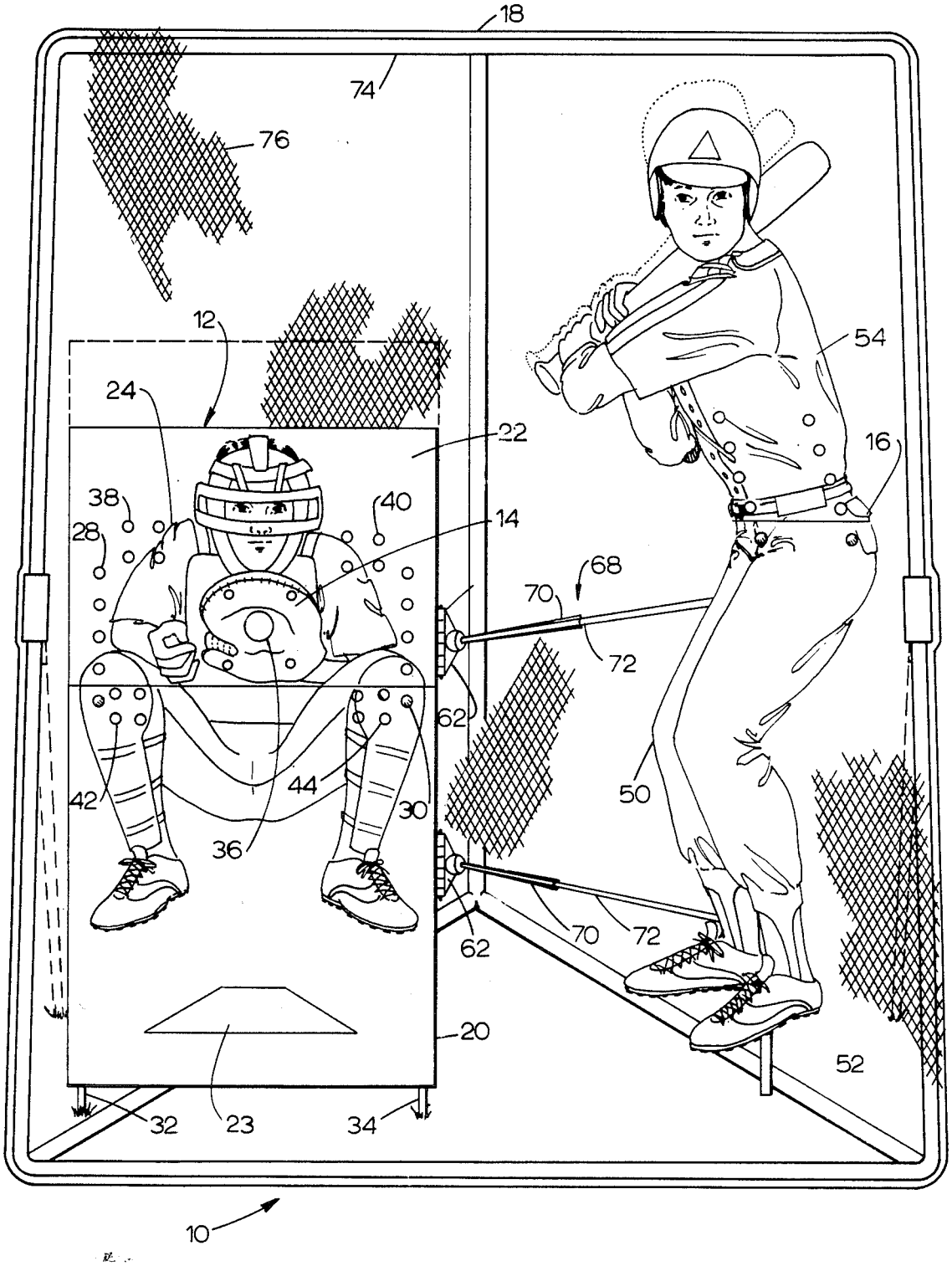
FIG. 1 is a view in front elevation of the pitcher's training device of this invention.
Figure 2:
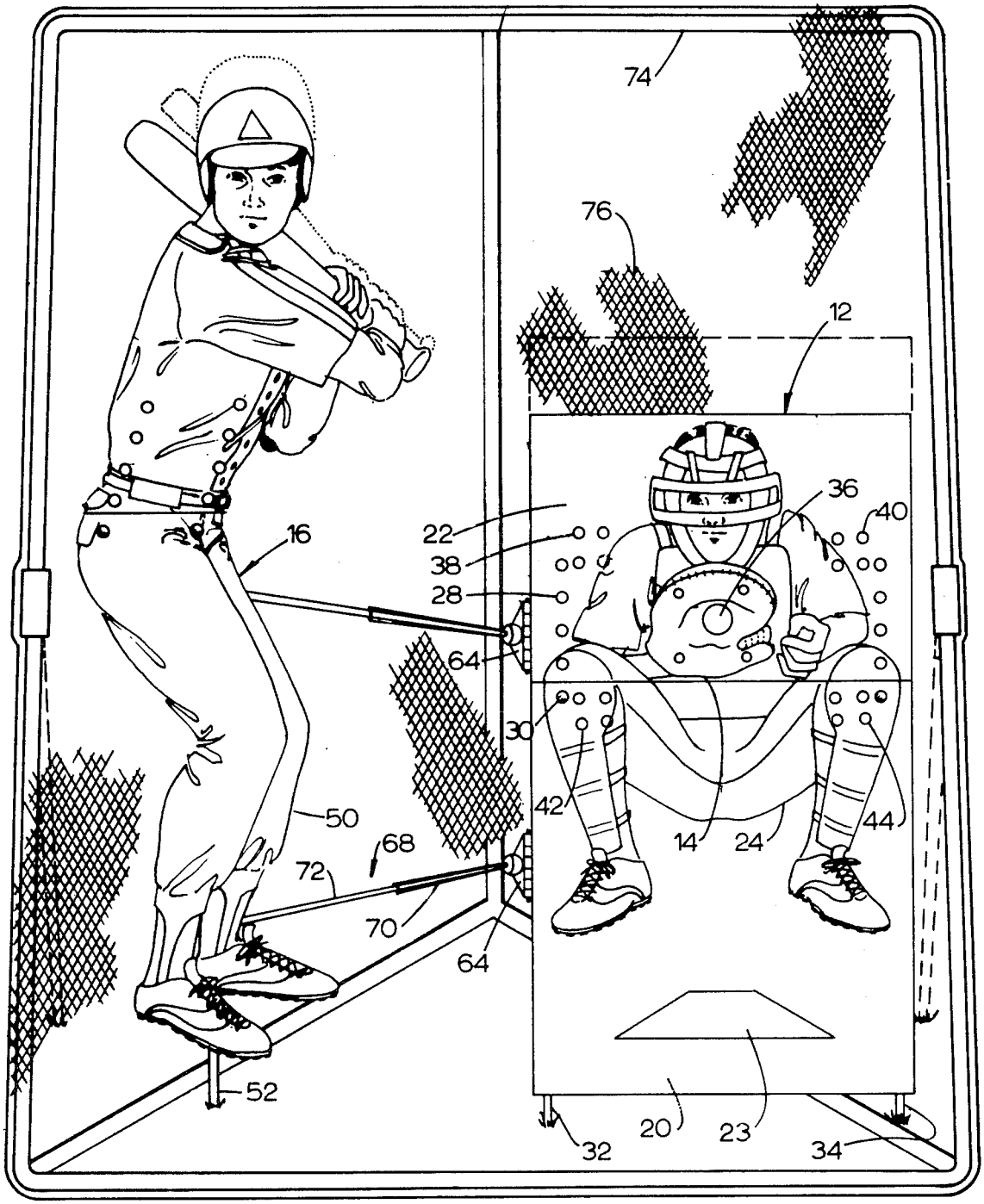
FIG. 2 is a view similar to FIG. 1, but showing the batter shifted from a right handed batter to a left handed batter.
Figure 4:
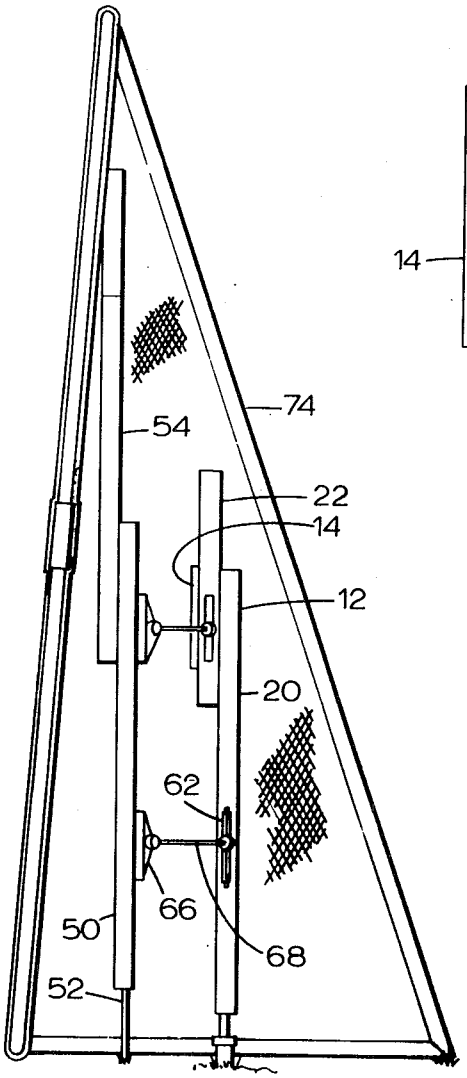
FIG. 4 is a view in side elevation taken from the right side of FIG. 1 showing the hinge structure.

The training device for baseball pitchers' of this invention is generally indicated by the reference numeral 10 in FIGS. 1, 2 and 4. It is comprised of an adjustable catcher's FIG. 12, a catcher's mitt 14 moveable to different positions, an adjustable batter FIG. 16 moveable to either a right handed or left handed position and a baseball retaining or stop net 18 for easy retrieval of thrown baseballs.

The catcher figure is constructed of conventional rigid sheet material shuch as plywood or the like. To provide shock resistance to thrown baseballs it may be provided with a cushion front surface (not shown) such as rubber, plastic or the like.

As shown in FIGS. 1, 2, 3 and 5, the catcher figure is comprised of a lower portion 20 and an upper portion 22. An outline 24 of a catcher in the crowded position is provided on the two halves which as shown in FIGS. 1 and 2 mated together to provide a life-like catcher figure of average size. The outline of a home plate 23 is also provided at the bottom of the lower portion 22 for a realistic touch.

The upper portion 22 of the catcher figure is adjustable to be raised as shown in dotted lines in FIGS. 1 and 2 or lowered to provide a taller or shorter outline 24 of the catcher to the pitcher. This feature provides valuable training for the pitcher to get used to pitching to different sized catchers.

Figure 5:
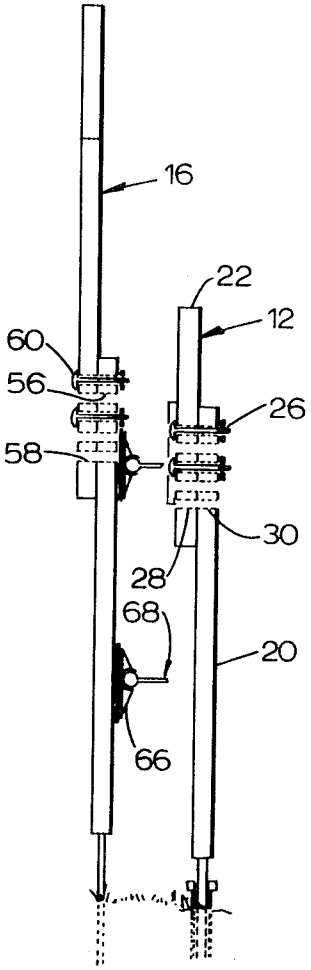
FIG. 5 is a view similar to FIG. 4 with the net removed showing the adjustment structure.
Figure 3:
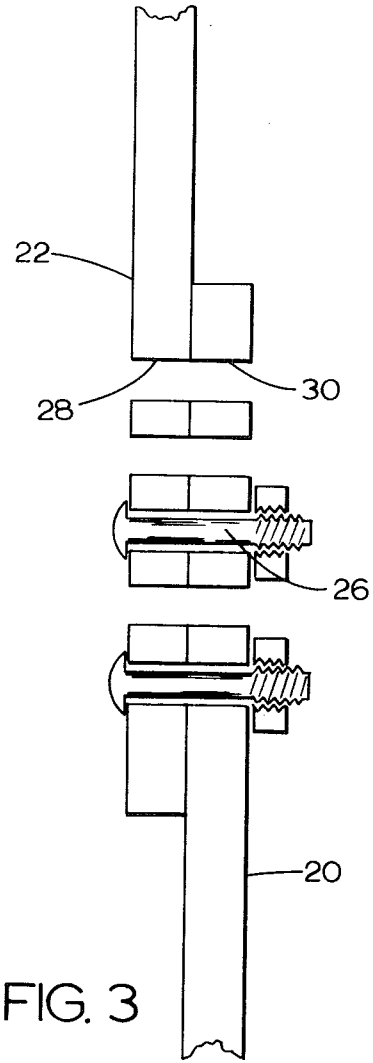
FIG. 3 is an enlarged fragmentary view in elevation taken from the right side of the catcher in FIG. 1 showing the height adjustment structure.

The adjustment of the two portions of the catcher figure is best shown in FIGS. 3 and 5. As there shown, a series of bolts 26 may be interfitted in a vertical series of holes 28 in the upper portion of the catcher figure and a corresponding vertical series of holes 30 in the lower portion of the catcher figure. By this means the upper portion may be easily raised or lowered upon the lower portion. Other adjustments may be used as will be readily understood such as a telescopic structure, ball and detent or the like.

For support of the catcher figure ground stakes 32 and 34 are employed. Where desired, a slanted rear prop rod or the like may be connected to the batter figure and rested upon the ground.

The catcher's mitt 14 moveably positioned upon the catcher figure is best shown in FIGS. 1, 2, 4 and 6. It is constructed in the shape of a catcher's glove and like the catcher figure may be constructed of sheet material with a resilient or shock absorbing front surface. A signal 36 is provided in the center of the mitt to indicate a perfect pitch. This may be a conventional battery operated light or an audible signal activated by contact of the well-thrown pitch.

Figure 6:
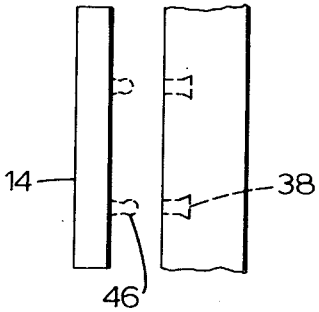
FIG. 6 is an enlarged fragmentary view taken from the right side of FIG. 1 showing the connection of the catcher's mitt to the catcher figure.

The catcher's mitt is adjustable upon the catcher figure to different positions to simulate the different positions of the catcher's mitt for dead, center, high, low, inside or outside pitches. As an example, a series of four holes 38, 40, 42 and 44 may be provided which receive four prongs 46 extending at the rear of the catcher's mitt as shown in FIGS. 1, 2 and 6. By such connection the catcher's mitt may be snapped into a selected series of holes at the different positions upon the catcher figure. Other means of adjustment may be similarly employed such as magnets or the like as will be readily understood.

The adjustable batter FIG. 16 is constructed in a somewhat similar fashion to that of the catcher figure but rather than being an outline on rectangular upper and lower members, it is shown in silhouette form. The uniform and other features are imprinted on both the front and back to provide visibility for both the right and left handed positions, shown in FIGS. 1 and 2. It will be understood that the catcher FIG. 14 may also be in similar silhouette form.

The batter figure like the catcher figure is constructed of rigid sheet material but with a resilient shock absorbing surface on both front and rear surfaces. The batter figure like the catcher figure is fashioned from a lower portion 50 rested on the ground by a ground stake 52 and a vertically adjustable upper portion 54 to increase or decrease the height of the batter.

The adjustment of the batter is effected by a series of vertical holes 56 in the lower portion and registrable holes 58 in the upper portion. Bolts 60 are employed to connect the two portions in different vertical positions as desired as best shown in FIGS. 1, 2 and 5.

The batter FIG. 16 is further connected to the catcher figure for both pivotal movement about a vertical axis and variable distancing between the two figures. This feature provides for different positions of the batter in the batter box both away from the catcher and to the front and rear of the batters's box to simulate crowding the plate and other positions to familiarize the pitcher with various relationships.

In order to provide the aforementioned pivotal movement a pair of hinges 62 and 64 are connected to both right and left sides, respectively, of the lower portion 20 of the catcher figure as shown in FIGS. 1 and 2. Similar hinges 66 are connected to the rear of the batter figure. Connecting the hinges on both the catcher figure and batter figure are telescopic support rods 68 having a female portion 70 connected to the hinge on the catcher figure and a male portion 72 connected to the rear of the lower portion 50 of the batter figure.

The hinges permit the relative pivotal movement of the batter while the telescopic rods provide not only the connection between the hinges, but variable distancing toward and away from the batter. When the batter figure is desired to be changed from the right handed position of FIG. 1 to the left handed position of FIG. 2, the batter figure with the male portion 72 is simply pulled out of the support position with the female telescopic portion 70 and the entire assembly is lifted and positioned in the left handed position of FIG. 2. Thus, the male portions 72 of the telescopic rods are inserted in the female portions 70 of the left hand hinges 64 on the lower portion 20 of the catcher figure and the ground stake 52 is rested upon the ground.

The ball retaining stop net 18 may be constructed of a light weight aluminum or plastic tubing frame 74. A net 76 covers the sides, top and rear of the frame. Through the tripod configuration of the frame as shown in FIGS. 1, 2 and 4, the frame simply rests upon the ground and provides a light weight structure which may be easily moved to any desired position. It may be made collapsible or in sections as will be readily understood.

USE

The baseball pitcher training device is very simply installed in any ground location desired. The catcher figure 12 is supported in the ground by the ground stakes 32 and 34. The upper and lower portions 20 and 22 are connected in the desired location by the bolts 26 interfitting in the selected holes 28 of the upper portion of the body and 30 of the lower portion. The catcher's mitt 14 is inserted in a selected position on the upper portion of the catcher figure by insertion of the releasable prongs 46 in one of the series of holes 38, 40, 42 and 44.

The batter FIG. 16 is then connected to the lower portion of the catcher figure in either the right of left handed position by inserting the male portions 72 of the telescopic support rod in the female portions 70 of the right hand hinges 62 or left hand hinges 64 on the lower portion of the catcher figure. The ground stake 52 provides a rest upon the ground. The ball retainer net 18 is then placed around the catcher and batter figures and the pitcher's training device is ready for use.

When it is desired to change the size of the catcher figure, the bolts 26 may be removed and the upper portion 22 of the body may be raised as shown in the dotted lines of FIGS. 1 and 2 or lowered. The bolts are simply reinserted in the new set of registering holes.

When the catcher's mitt 14 is desired to be moved to a different target position, it is simply pulled away from the quick release interfit of the prongs 46 from the holes 38, as an example, in the upper portion of the catcher figure. The catcher's mitt is then simply pushed into engagement of the prongs with the holes in the newly selected position. In any of the positions the signal 36 on the catcher's mitt provides indication of a perfect pitch by a visual light or sound alarm when the pitch is directly on target.

The batter FIG. 16 provides for pivoting movement with respect to the catcher FIG. 12 through the hinges 62 and 64 on the catcher figure and the hinge 66 on the batter figure connected by the support rods 68. The batter figure is simply lifted slightly off the ground when pivoted to free the ground stake 52 or the ground stake may be even dragged since it only acts as a rest.

When the distance between the batter figure and the catcher figure is desired to be increased or decreased, the support rod 68 and telescopic interfit of the female portions 70 with the male portions 72 permit movement of the batter figure away from or toward the catcher figure. Thus, the batter figure may be simply lifted a slight degree as in the pivotal movement to clear the ground stake or the ground stake may be dragged in the movement of the batter figure toward or away from the catcher figure.

The size of the batter FIG. 16 is varied in much the same manner as that of the catcher figure. The bolts 60 may be removed from the holes 58 and 60 in the upper and lower portions 50 and 52 of the batter figure and the upper portion may be moved upwardly as indicated in the dotted lines of FIGS. 1 and 2 or downwardly with the bolts being reinserted in the registrable holes 58 and 60 of the two portions of the batter figure.

By the various changes in the size of the catcher figure and batter figure, a feel by the pitcher of different catchers and batters may be realized. The change in position of the catcher's mitt and pivotal movement and variable distancing of the batter figure presents a situation of different types of batters that simulate the different conditions encountered in real game situations.

Various changes and modifications may be made within this invention as will be apparent to those skilled in the art. Such changes and modifications are within the scope and teaching of this invention as defined in the claims appended hereto.

What is claimed is:

1. A training device for baseball pitchers comprising a life-size catcher figure, means for supporting said catcher figure upon a ground surface a catcher's mitt member having means for support upon said catcher figure, a life-size batter figure supported from said catcher figure in interchangeable left and right handed positions on opposite sides of said catcher figure, said catcher figure having means for adjusting the height to simulate different sized catchers, said batter figure having independent means for adjusting the height to simulate different sized batters, the batter figure having means for pivoting about a vertical axis to simulate different positions of adjustment in each of said right and left handed positions of the batter in a batter's box.

2. The training device of claim 1 in which means are provided for supporting the catcher's mitt member at different positions on the catcher figure.

3. The training device of claim 2 in which a central portion of the catcher's mitt member is provided with a signal responsive to contact by a thrown baseball to indicate an on target pitch.

4. The training device of claim 1 in which the means for pivoting the batter figure comprises a hinge supported upon the catcher figure and connecting the batter figure to said catcher figure.

5. A training device for baseball pitchers comprising a life-size catcher figure, means for supporting said catcher figure upon a ground surface, a catcher's mitt member having means for support upon said catcher figure, a life-size batter figure supported from said catcher figure in interchangeable left and right handed positions, said catcher figure having means for adjusting the height to simulate different sized catchers, said batter figure having independent means for adjusting the height to simulate different sized batters and means are provided for varying the distance between the batter figure and catcher figure to simulate different positions of the batter figure in a batter's box.

6. The training device of claim 5 in which the batter figure has means for pivoting about a vertical axis.

7. The training device of claim 6 in which the means for pivoting the batter figure comprises a hinge supported upon the catcher figure and connecting the batter figure to said catcher figure and the means for varying the distance between the catcher figure and the batter figure comprises a telescopic member connecting said figures.

8. The training device of claim 7 in which said batter figure has depending ground stakes for supporting said batter figure upon the ground.

9. The training device of claim 7 in which means are provided for supporting the catcher's mitt member at different positions on the catcher figure.

10. The training device of claim 7 in which means are provided for supporting the catcher's mitt member at different positions on the catcher figure and a central portion of the catcher's mitt member is provided with a signal responsive to contact by a thrown baseball to indicate an on target pitch.

11. The training device of claim 10 in which a ground supported frame provided with a net encloses the top, sides and rear of the catcher and batter figures.

12. The training device of claim 5 in which the means for varying the distance between the catcher figure and the batter figure comprises a telescopic member connecting said figures.

* * * * *